United States Patent [19]

Duffour et al.

[11] Patent Number: 4,877,928

[45] Date of Patent: Oct. 31, 1989

[54] RELEASE MECHANISM FOR A HIGH SPEED CIRCUIT BREAKER

[75] Inventors: Henri Duffour, Douvaine, France; Serge Martin, Meyrin; Ernst Studer, Genf, both of Switzerland

[73] Assignee: BBC Brown Boveri Ltd., Baden, Switzerland

[21] Appl. No.: 222,639

[22] Filed: Jul. 21, 1988

[30] Foreign Application Priority Data

Jul. 22, 1987 [CH] Switzerland ..... 2776/87

[51] Int. Cl.[4] ..... H01H 33/02

[52] U.S. Cl. ..... 200/144 R; 200/400; 200/411; 200/425

[58] Field of Search ..... 200/144 R, 147 R, 400, 200/411, 415, 424, 425, 428

[56] References Cited

U.S. PATENT DOCUMENTS 1,966,188 7/1934 Slepian ..... 200/144 R 3,111,565 11/1963 Bunke ..... 200/425

*Primary Examiner*—Robert S. Macon

*Attorney, Agent, or Firm*—Burns, Doane, Swecker & Mathis

[57] ABSTRACT

A release mechanism for a high speed circuit breaker comprises a roller rotatably supported on an axle in a mobile contact bridge. A jack is acting in the circuit closing direction on the roller, and the frontal side of the jack is in the form of a slide. The force of a disconnecting spring acts on the contact bridge in a disconnecting direction. The release mechanism to be provided with the connected contact bridge is capable of very rapid release, so that high short circuit currents may be interrupted very rapidly. This is obtained by the slide having a configuration such that in the connected state of the contact bridge the frictional forces acting on the roller are compensated.

4 Claims, 2 Drawing Sheets

RELEASE MECHANISM FOR A HIGH SPEED CIRCUIT BREAKER

BACKGROUND OF THE INVENTION

1. Field of the Invention

The invention relates to a release mechanism for a high speed circuit breaker.

2. Description of Related Art

A release mechanism is used with a high speed circuit breaker with a roller rotatingly mounted in a mobile contact bridge on an axle. To close the circuit, a jack actuated by a magnet acts on the roller, pressures the contact bridge against a stationary contact, and closes the circuit through the high speed circuit breaker. The necessary contact pressure is also applied by the magnet through the jack to the roller. In a normal disconnection of the high speed circuit breaker the magnet is deactivated and a prestressed disconnect spring also acting on the roller, draws the contact bridge into the disconnect position. The arc appearing in the process is extinguished in a known manner. If, however, a short circuit current flows through the high speed circuit breaker, this normal disconnect requires too much time and a trigger directly actuated by the short circuit current is actuated. This trigger acts on the jack and causes the gear connection between the roller and the jack to be released. The disconnect spring acting on the roller then becomes immediately effective and the contact bridge is drawn rapidly in the disconnect direction.

The trigger acting on the jack, for example, a trigger magnet, must be dimensioned substantially so as to move the jack safely relative to the roller, as there are large counter forces to be overcome. If the trigger is designed somewhat weaker, the disconnect time is increased to unacceptable values.

SUMMARY OF THE INVENTION

The present invention is intended to remedy this situation. The present invention solves the problem by creating a release mechanism for an actuated contact bridge of a high speed circuit breaker, which may be disconnected very rapidly, so that high disconnect currents, in particular short circuit currents, may be interrupted in a particularly rapid manner.

The advantage obtained by the present invention is that immediately after the release of the release mechanism, one component of the force still acting on the roller in the circuit closing direction additionally accelerates the motion of the jack, thereby making possible an even more rapid disconnect movement of the contact bridge.

The invention, its further development and the advantages obtained by it are explained in more detail with reference to the drawings, which represent merely one embodiment.

DETAILED DESCRIPTION OF PREFERRED EMBODIMENTS

Figure 1:
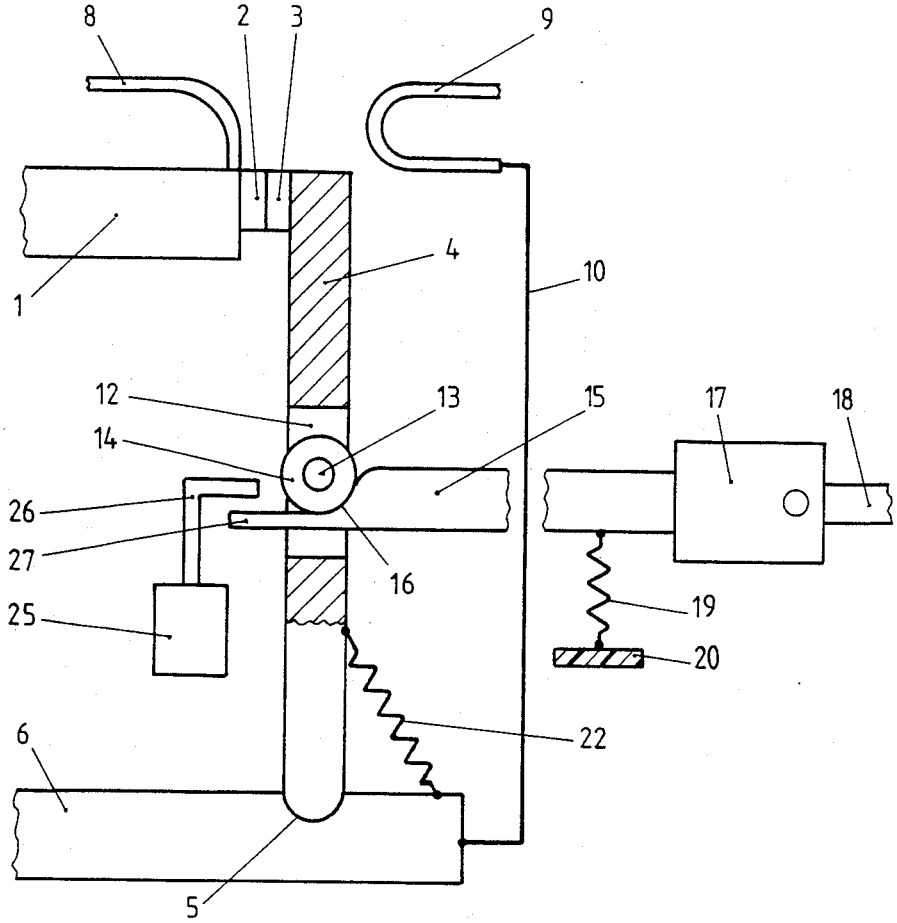
FIG. 1 is a diagram of a contact system of a high speed circuit breaker of the present invention.

FIG. 1 shows a contact system of a high speed circuit breaker in a simplified manner. A stationary contact 2 is fastened to a busbar 1. In the closed state of the circuit, a mobile contact piece 3 is pressured onto the stationary contact 2, said mobile contact piece 3 being connected with one end of a mobile contact bridge 4. The mobile contact bridge 4 is supported at its other end rotatingly in a rolling bearing 5, capable of conducting the current. This rolling bearing 5 is set into a busbar 6. The aforedescribed structural elements 1 to 6 constitute the principal, current path of the high speed circuit breaker. In the course of the disconnect process, when an arc burning between the stationary contact 2 and the contact piece 3 commutates in a known manner between spark conductors 8 and 9, a subcircuit 10 is briefly exposed to the current. The contact bridge 4 then no longer carries any current and moves without any further electrical load into its disconnect position. As soon as the arc, which in a known manner jumps from the spark conductors 8, 9 to a plurality of quenching plates (not shown) is extinguished, the current is definitively interrupted by the high speed circuit breaker. Between the stationary contact 2 and the contact piece 3, the recovery voltage then exists.

The contact bridge 4 has an opening 12 in the direction of its longitudinal axis. The lateral wall of this opening 12 supports an axle 13 upon which a cylindrical roller 14 is supported rotatingly. The axle 13 and the roller 14 have a common central axis extending perpendicularly to the direction of motion of the contact bridge 4. In the closed condition of the contact bridge 4, the roller 14 rests on a jack 15, the frontal side of which faces the roller 14 and is in the form of a slide 16 adapted, at least in part, to the contour of the roller 14. The end of the jack 15 facing away from the roller is supported rotatingly in an insulating part 17. A connecting piece 18 connects the insulating part 17 with a circuit closing and disconnecting device, known in principle and not shown. A spring 19, resting on a support 20 of an insulating material, pressures the jack 15 upward against the roller 14. The closing and disconnecting device acts by means of the jack 15 on the roller 14 and thus on the contact bridge 4. In the closed state it also supplies the contact force between the stationary contact 2 and the contact piece 3, and any contact burn is compensated automatically.

The forces acting on the contact bridge 4 in the circuit closing direction are supplied by the closing and disconnecting device. For a normal operational disconnection the force acting in the connecting direction is cancelled and the disconnecting spring 22 acts directly on the contact bridge 4, drawing the latter into its disconnecting position. The disconnecting spring 22 is suspended in an insulated manner on at least one side, in order to avoid stray currents through the disconnecting spring.

If very high currents, for example short circuit currents, are to be disconnected, the disconnecting process must be accelerated. An additional trigger 25, for example, a magnet actuated directly by the high current, acts by means of a jack 26 on the end 27 of the jack 15 projecting through the opening 12. In the process, the jack 15 is pressured downward and the roller 14 rolls along the slide 16 in the disconnecting direction. The connection between the roller 14 and the jack 15 is released very rapidly in this manner.

Figure 2:
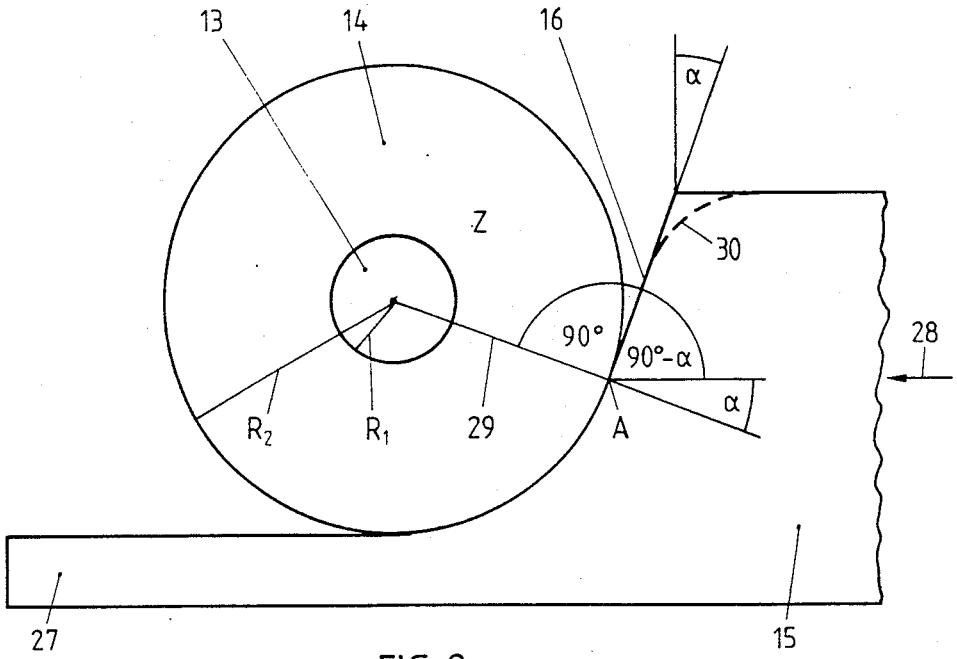
FIG. 2 is a detailed diagram of the release mechanism according to the present invention.

To render apparent the mode of operation of this release mechanism, FIG. 2 is considered in detail. The frontal side of the jack 15, in the form of the slide 16, is adapted partially to the contour of the roller. At a point A the part of the slide 16 adapted to the roller contour passes into a section extending tangentially to the roller 14. The slide 16 has a configuration such that in the connected state of the contact bridge 4 the forces acting on the roller 14 are compensated. The section extending tangentially to the roller 14 of the slide 16 is inclined relative to the connecting direction by an angle equal to $90°-\alpha$. The connecting direction is indicated by an arrow 28. The angle $\alpha$ is defined as the angle between the connecting direction and the connecting line 29 connecting the point A with the center Z of the axle 13. The same angle $\alpha$ also appears as the angle between the section of the slide 15 extending tangentially to the roller 14 and a line extending perpendicularly to the connecting direction of the jack 15. It is not necessary for the section extending tangentially to the roller 14 of the slide 16 to extend to the upper edge of the jack 15 in a straight edge, it may also be slightly rounded as indicated by a broken line 30, in order to facilitate the rolling off of the roller 14.

Figure 3:
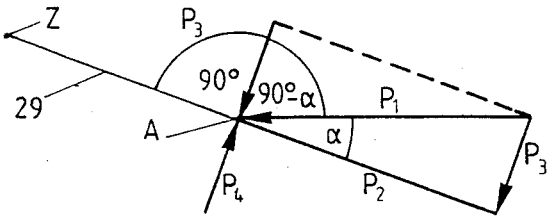
FIG. 3 is an illustration of the forces acting on the release mechanism according to FIG. 2.

FIG. 3 shows the essential forces acting at the point A between the roller 14 and the jack 15. A force $P_1$ is acting in the connecting direction, it is applied by the circuit closing and disconnecting device. This force $P_1$ may be resolved in its components $P_2$ and $P_3$. The component $P_2$ acts in the direction of the center Z of the axle 13. The component $P_3$, which may be represented by the relation $P_3=P_1\times\sin\alpha$, is perpendicular to the component $P_2$. The component $P_3$ may be displaced in the parallel direction, until its direction of action coincides with the direction of the tangentially extending section of the slide 16. It then acts from above onto the point A. This force component $P_3$ applies against the force $P_4$, a force of exactly the same size on the same axle. This force $P_4$ is the sum of the frictional forces appearing in the system of the axle 13, the roller 14 and the slide 16.

The friction force $P_{41}$ appearing between the roller 14 and the slide 16 is determined by the relationship $P_{41}=P_1\times\cos\alpha\times C_6$, wherein $C_6$ is the coefficient of friction between the roller 14 and the slide 16. The friction force between the axle 13 and the roller 14 is reduced in the proportion of the radius $R_1$ of the axle 13 to the radius $R_2$ of the roller 14. Of the latter friction force the component $$P_{42}=P_1\times\cos\times C_5\times(R_1/R_2).$$

The force $P_4$ is determined by the relationship $P_4=P_{41}+P_{42}$.

If the component $P_3$ and the force $P_4$ are set equal to each other, the following equation is obtained for the dimension of the angle $\alpha$:

$$\tan\alpha=C_5\times R_1/R_2+C_6.$$

The roller 14 may have an outer running surface, into which a groove-like recess is set. This recess serves as a guide for the frontal side of the jack 15. Any lateral slipping off of the jack 15 from the roller 14 is thereby prevented. It is further possible to adapt the frontal side of the jack 15 to the shape of the recess of the roller 14, in order to obtain an even better guidance.

Although the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A release mechanism for a high speed circuit breaker, comprising:

a mobile contact bridge;

an axle in the mobile contract bridge;

a roller supported rotatably on the axle in the mobile contact bridge;

a rotatably supported jack acting in the circuit closing direction on the roller;

the frontal side of the jack facing the roller being in the form of a slide adapted at least in part to the contour of said roller;

means for exerting a force acting on the contact bridge in the disconnecting direction; and a trigger acting on the jack;

said slide having a configuration such that in the circuit closing state of the contact bridge, the frictional forces acting on the roller are compensated.

2. The release mechanism according to claim 1, wherein:

the part of the slide adapted to the contour of the roller continues into a section extending tangentially to the roller; and the section of the slide extending tangentially to the roller is inclined relative to the circuit closing direction by an angle $(90°-\alpha)$, with the angle $(\alpha)$ having the following dimension:

$$\tan\alpha=C_5\times R_1/R_2+C_6,$$

wherein $C_5$ is the coefficient of friction between the axle and the roller, $C_6$ is the coefficient of friction between the roller and the slide, $R_1$ is the radius of the axle, and $R_2$ is the radius of the roller.

3. The release mechanism according to claim 1, wherein the running surface of the roller includes a recess serving as a guide for the frontal side of the jack.

4. The release mechanism according to claim 3, wherein the frontal side of the jack is adapted to the shape of the recess.

* * * * *